US008711050B2

(12) United States Patent
Chiu et al.

(10) Patent No.: US 8,711,050 B2
(45) Date of Patent: Apr. 29, 2014

(54) MULTI-BAND DIPOLE ANTENNA

(75) Inventors: Chieh-Ping Chiu, Tianwei (TW); Feng-Jen Weng, Kuei Shan Hsiang (TW); I-Ping Yen, New Taipei (TW); Hsiao-Wei Wu, Zhongli (TW)

(73) Assignee: Quanta Computer Inc. (TW)

( * ) Notice: Subject to any disclaimer, the term of this patent is extended or adjusted under 35 U.S.C. 154(b) by 291 days.

(21) Appl. No.: 13/079,411

(22) Filed: Apr. 4, 2011

(65) Prior Publication Data

US 2012/0127051 A1 May 24, 2012

(30) Foreign Application Priority Data

Nov. 18, 2010 (TW) ..... 99139713 A

(51) Int. Cl.
*H01Q 21/12* (2006.01)

(52) U.S. Cl.
USPC ..... 343/814; 343/795; 343/797

(58) Field of Classification Search
USPC ..... 343/814, 795, 797, 806
See application file for complete search history.

(56) References Cited

U.S. PATENT DOCUMENTS

| | | | | |
|---|---|---|---|---|
| 5,898,411 | A * | 4/1999 | McGaffigan et al. | 343/801 |
| 6,961,028 | B2 * | 11/2005 | Joy et al. | 343/895 |
| 6,975,278 | B2 * | 12/2005 | Song et al. | 343/795 |
| 8,358,247 | B2 * | 1/2013 | Chiu et al. | 343/700 MS |
| 2004/0012534 | A1 | 1/2004 | Dai et al. | |
| 2005/0035919 | A1 | 2/2005 | Yang et al. | |
| 2008/0024378 | A1 * | 1/2008 | Kanno et al. | 343/770 |
| 2012/0001818 | A1 * | 1/2012 | Lee et al. | 343/817 |

FOREIGN PATENT DOCUMENTS

CN 101106211 A 1/2008

OTHER PUBLICATIONS

State Intellectual Property Office of the P.R.C. Search Report for Application No. 2010105826503 issued on Dec. 4, 2013, 4 pages.

* cited by examiner

*Primary Examiner* — Ahshik Kim
(74) *Attorney, Agent, or Firm* — Sunstein Kann Murphy & Timbers LLP

(57) ABSTRACT

A multi-band dipole antenna includes spaced part first and second radiator sections, first and second mirroring radiator sections, and a balun, which are disposed on a substrate. The first mirroring radiator section is symmetrically disposed with respect to the first radiator section and is spaced apart from the first radiator section. The first radiator section and the first mirroring radiator section cooperate to resonate in a first frequency band. The second radiator section cooperates with the second mirroring radiator section to resonate in a second frequency band.

10 Claims, 7 Drawing Sheets

1 : 2.688 824MHz
2 : 2.774 960MHz
3 : 1.585 1710MHz
4 : 1.53 1990MHZ
5 : 1.744 2170MHz

Penta Band Dipole GSM850 836.6 MHz
Efficiency = -1.8 dB,Gain = 1.3 dBi
@(90,0)

H Plane(X-Y Plane, $\theta$ =90)

Peak= 1.3 dBi , Avg = 2.6 dBi

E1 Plane(Z-X Plane, $\phi$ =0)

Peak= 1.3 dBi , Avg = -0.1 dBi

E2 Plane(Z-Y Plane, $\phi$ =90)

Peak= 0.4 dBi , Avg = -2.6 dBi

Penta Band Dipole_DCS 1747.8 MHz

Efficiency = -0.9 dB,Gain = 3.3 dBi

@(45,0)

H Plane(X-Y Plane, $\theta$ =90)

Peak= 1.5 dBi , Avg = -2.4 dBi

E1 Plane(Z-X Plane, $\phi$ =0)

Peak= 3.3 dBi , Avg = 1.2 dBi

E2 Plane(Z-Y Plane, $\phi$ =90)

Peak= 1.3 dBi , Avg = -2.2 dBi

Penta Band Dipole_WCDMA 1950 MHz

Efficiency = -1.2 dB,Gain = 2.9 dBi

@(90,0)

H Plane(X-Y Plane, $\theta$ =90)

Peak= 2.9 dBi , Avg = -1.3 dBi

E1 Plane(Z-X Plane, $\phi$ =0)

Peak= 2.9 dBi , Avg = 0.7 dBi

E2 Plane(Z-Y Plane, $\phi$ =90)

Peak= 1 dBi , Avg = -2.5 dBi

MULTI-BAND DIPOLE ANTENNA

CROSS-REFERENCE TO RELATED APPLICATION

This application claims priority of Taiwanese Application No. 099139713, filed on Nov. 18, 2010.

BACKGROUND OF THE INVENTION

1. Field of the Invention

The present invention relates to a dipole antenna, more particularly to a multi-band dipole antenna.

2. Description of the Related Art

Dipole antennas have a relatively simple structure and high omni-directionality, and are thus widely used in wireless transmission systems.

However, conventional dipole antennas are usually not designed to be compatible with various communication protocols. Therefore, it is desirable to have an antenna capable of operating at various wireless communication frequency bands.

SUMMARY OF THE INVENTION

Therefore, the object of the present invention is to provide a multi-band dipole antenna capable of operating at various frequency bands.

Accordingly, a multi-band dipole antenna of this invention includes a substrate, a first radiator section, a second radiator section, a first mirroring radiator section, a balun, and a second mirroring radiator section.

The first radiator section is disposed on the substrate and has a first grounding end and a first conductor arm extending from the first grounding end in a first direction. The second radiator section is disposed on the substrate, is spaced apart from the first radiator section, and has a second grounding end and a second conductor arm extending from the second grounding end in a second direction. The first mirroring radiator section is symmetrically disposed on the substrate with respect to the first radiator section and is spaced apart from the first radiator section. The first radiator section and the first mirroring radiator section have substantially equal lengths. The first mirroring radiator section includes a feed-in end adjacent to the first grounding end and a first mirroring conductor arm extending from the feed-in end in a direction opposite to the first direction. The first radiator section cooperates with the first mirroring radiator section to resonate in a first frequency band. The balun is disposed on the substrate and has a main body, a first connecting end electrically connected to the first mirroring radiator arm, and a third grounding end. The first connecting end and the third grounding end are disposed respectively on opposite ends of the main body. The second mirroring radiator section is disposed on the substrate and includes a second connecting end electrically connected to the main body of the balun, and a second mirroring conductor arm extending from the second connecting end in a direction opposite to the second direction. The second radiator section cooperates with the second mirroring radiator section to resonate in a second frequency band.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
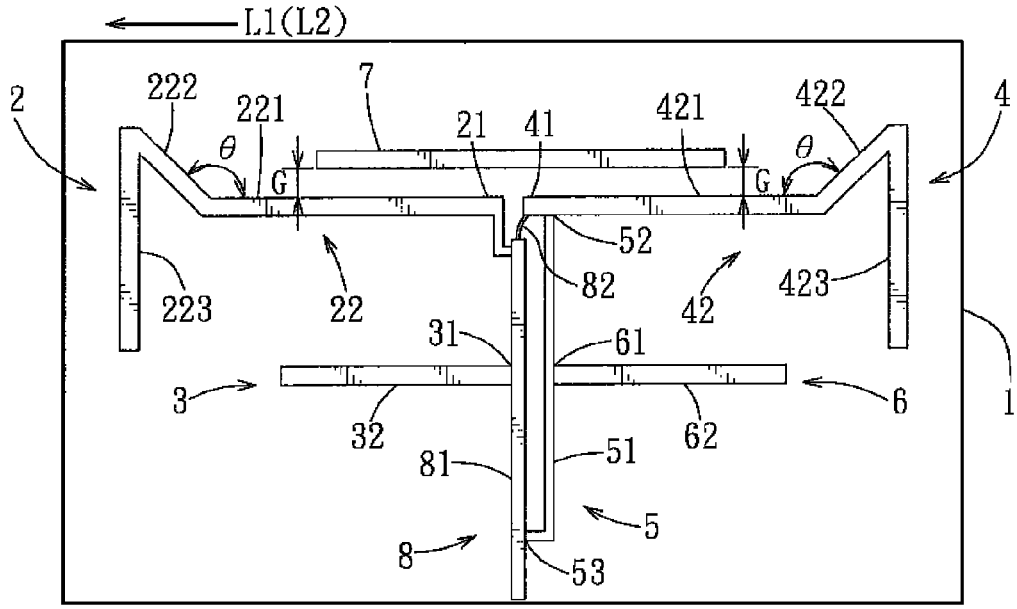
FIG. 1 is a schematic diagram of a preferred embodiment of a multi-band dipole antenna according to the present invention.

Referring to FIG. 1, a preferred embodiment of the multi-band dipole antenna of the present invention includes a substrate 1, a first radiator section 2, a second radiator section 3, a first mirroring radiator section 4, a balun 5, a second mirroring radiator section 6, a third radiator section 7, and a coaxial transmission cable 8. In this embodiment, the substrate 1 is a microwave substrate.

The first radiator section 2 is disposed on the substrate 1 and has a first grounding end 21 and a first conductor arm 22 extending from the first grounding end 21 in a first direction (L1). The first conductor arm 22 includes a first radiator portion 221 connected to the first grounding end 21, a second radiator portion 222 extending at an angle θ from one end of the first radiator portion 221 opposite to the first grounding end 21, and a third radiator portion 223 extending from one end of the second radiator portion 222 opposite to the first grounding end 21 and forming a bend with the second radiator portion 222. Therefore, the area occupied by the antenna is reduced. In this embodiment, the first radiator portion 221 extends toward a left end of the substrate 1 in the drawings.

The second radiator section 3 is disposed on the substrate 1, is spaced apart from the first radiator portion 221 of the first radiator arm 22, and has a second grounding end 31 and a second conductor arm 32 extending from the second grounding end 32 in a second direction (L2). In this embodiment, the second direction (L2) is substantially the same as the first direction (L1), i.e., the second radiator arm 32 extends toward the left end of the substrate 1 in the drawings, and is substantially parallel to the first radiator portion 221 of the first radiator arm 22.

The first mirroring radiator section 4 is symmetrically disposed on the substrate 1 with respect to the first radiator section 2 and is spaced apart from the first radiator section 2. The first radiator section 2 and the first mirroring radiator section 4 have substantially equal lengths. The first mirroring radiator section 4 includes a feed-in end 41 adjacent to the first grounding end 21 and a first mirroring conductor arm 42 extending from the feed-in end 41 in a direction opposite to the first direction (L1). The first mirroring conductor arm 42 includes a first mirroring radiator portion 421 connected to the feed-in end 41, a second mirroring radiator portion 422 extending at an angle θ from one end of the first mirroring radiator portion 421 opposite to the feed-in end 41, and a third mirroring radiator portion 423 extending from one end of the second mirroring radiator portion 422 opposite to the feed-in end 41 and forming a bend with the second mirroring radiator portion 422. The first radiator portion 221 and the first mirroring radiator portion 421 are disposed on a common line. The first radiator section 2 cooperates with the first mirroring radiator section 4 to resonate in a first frequency band.

The balun 5 is disposed on the substrate 1 and has a main body 51, a first connecting end 52 electrically connected to the first mirroring radiator conductor arm 42, and a third grounding end 53. The first connecting end 52 and the third grounding end 53 are disposed respectively on opposite ends of the main body 51. In this embodiment, the main body 51 of the balun 5 extends in a direction transverse to the first direction (L1), and the first connecting end 52 is disposed adjacent to the feed-in end 41.

The second mirroring radiator section 6 is disposed on the substrate 1, is spaced apart from the first mirroring radiator portion 421 of the first mirroring conductor arm 42, and includes a second connecting end 61 electrically connected to the main body 51 of the balun 5, and a second mirroring conductor arm 62 extending from the second connecting end 61 in a direction opposite to the second direction (L2). The second radiator section 3 cooperates with the second mirroring radiator section 6 to resonate in a second frequency band. In this embodiment, the second conductor arm 32 and the second mirroring conductor arm 62 are disposed on a common line, and the second connecting end 61 of the second mirroring radiator section 6 is disposed adjacent to a central part of the main body 51 of the balun 5.

The third radiator section 7 is disposed on the substrate 1 and is substantially parallel to the first radiator portion 221 of the first radiator section 2 and the first mirroring radiator portion 421 of the first mirroring radiator section 4. The third radiator section 7 forms a clearance (G) with each of the first radiator portion 221 and the first mirroring radiator portion 421, such that the first radiator section 2, the third radiator section 7, and the first mirroring radiator section 4 cooperate to resonate in a third frequency band.

The coaxial transmission cable 8 is disposed on the substrate 1 and has an inner conductor 82 that is electrically connected to the feed-in end 41 and an outer conductor 81 that is electrically connected to each of the first, second and third grounding ends 21, 31, 41.

In this embodiment, the coaxial transmission cable 8 is spaced apart from and parallel to the balun 5. the coaxial transmission cable 8 and the balun 5 are disposed between the second radiator section 3 and the second mirroring radiator section 6.

Figure 2:
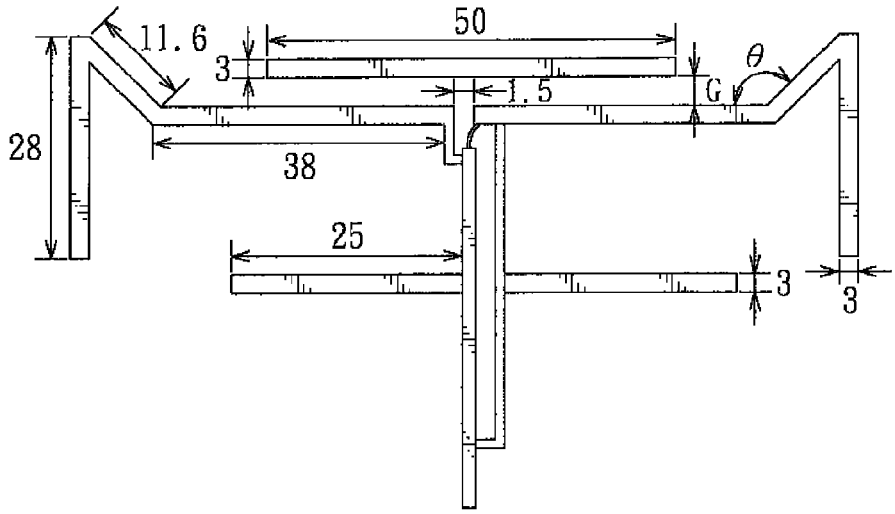
FIG. 2 is a schematic diagram illustrating dimensions of the preferred embodiment.

Referring to FIG. 2, the detailed dimensions (in mm) of the multi-band dipole antenna of the preferred embodiment are shown. Preferably, width of the clearance (G) is 1 mm, and the angle θ is substantially equal to 130°. Bandwidth of the first frequency band is dependent upon dimensions of the first radiator section 2 and the first mirroring radiator section 4, bandwidth of the second frequency band is dependent upon dimensions of the second radiator section 3 and the second mirroring radiator section 6, and bandwidth of the third frequency band is dependent upon dimensions of the third radiator section 7. Additionally, impedance matching and bandwidth of the third frequency band are dependent upon dimensions of the clearance (G). In this embodiment, the center frequency of the first frequency band is 900 MHz, the center frequency of the second frequency band is 1800 MHz, and the center frequency of the third frequency band is 2100 MHz. The preferred embodiment may be applied to frequency bands GSM850 (824~894 MHz), GSM 900 (880~960 MHz), DCS (1710~1880 MHz), PCS (1850~1990 MHz), and WCDMA Band I (1920~2170 MHz).

Figure 3:
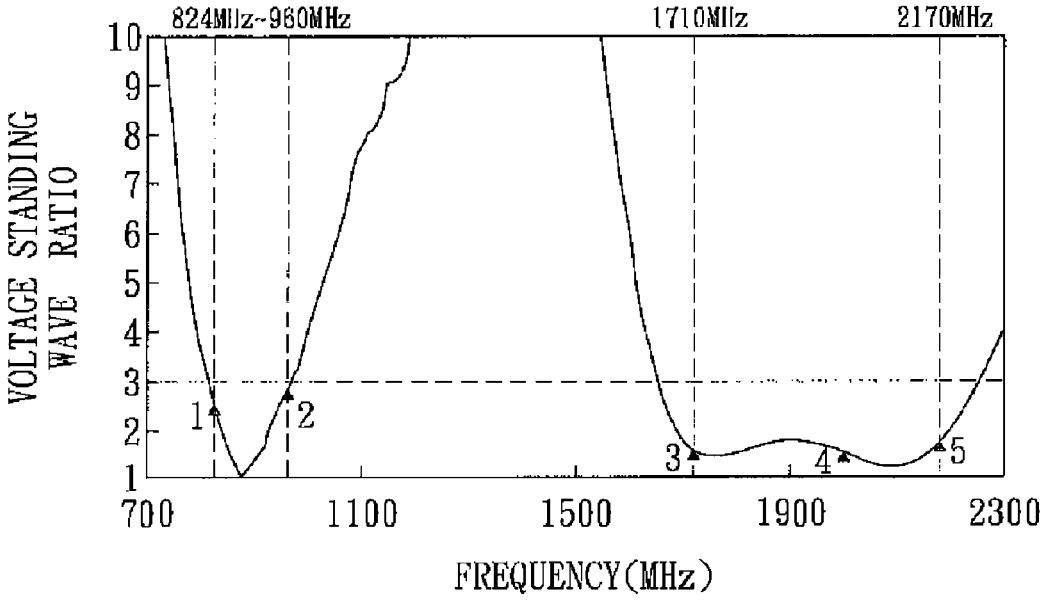
FIG. 3 is a Voltage Standing Wave Ratio (VSWR) plot showing VSWR values of the preferred embodiment.
Figure 4:
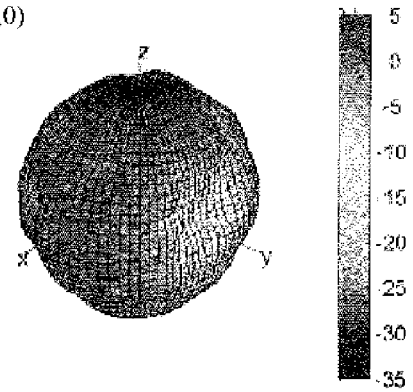
FIG. 4 illustrates radiation patterns of the preferred embodiment operating at 836.6 MHz.
Figure 4:
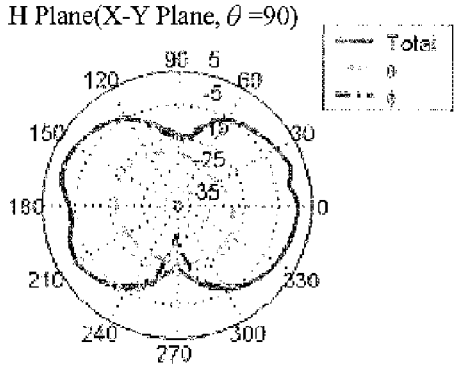
Figure 4:
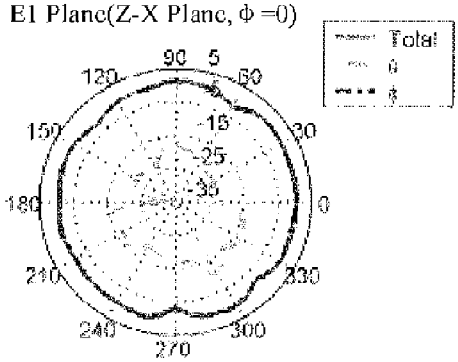
Figure 4:
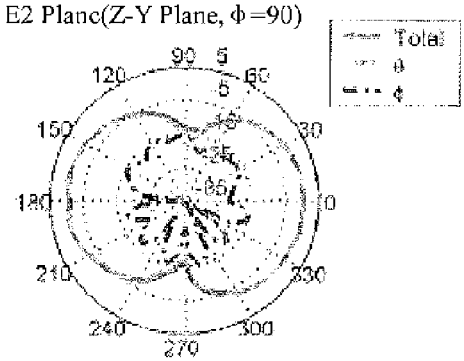
Figure 5:
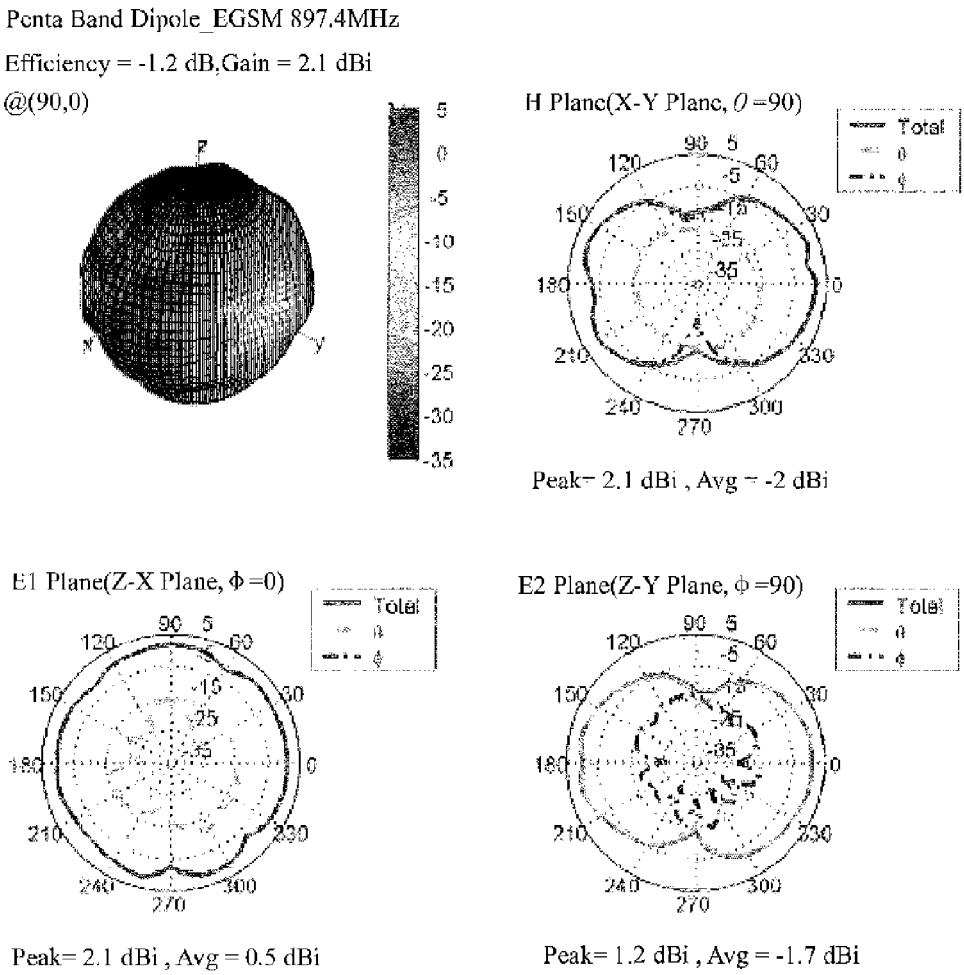
FIG. 5 illustrates radiation patterns of the preferred embodiment operating at 897.4 MHz.
Figure 6:
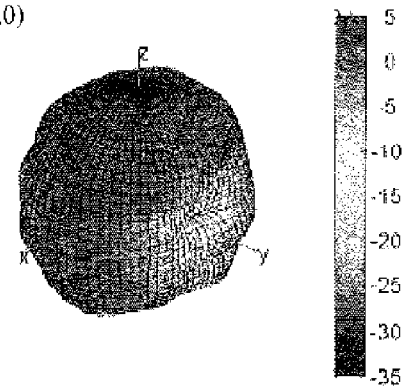
FIG. 6 illustrates radiation patterns of the preferred embodiment operating at 1747.8 MHz.
Figure 6:
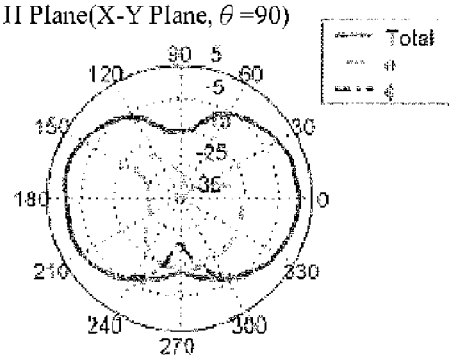
Figure 6:
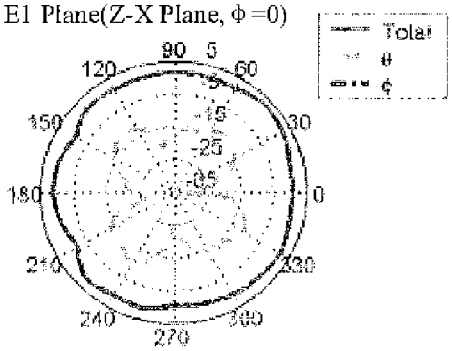
Figure 6:
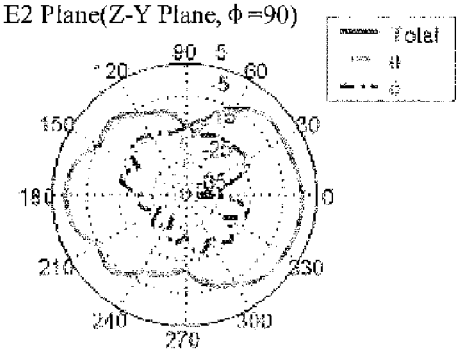
Figure 7:
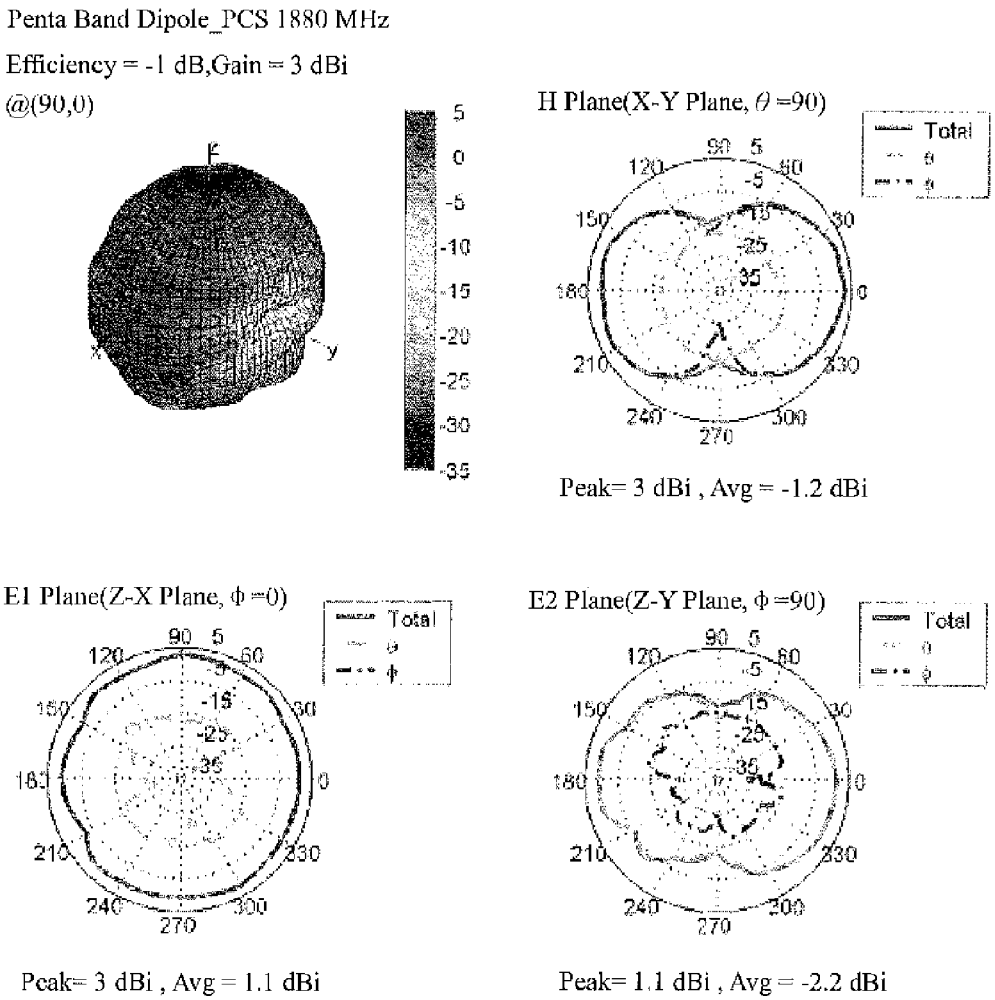
FIG. 7 illustrates radiation patterns of the preferred embodiment operating at 1880 MHz.
Figure 8:
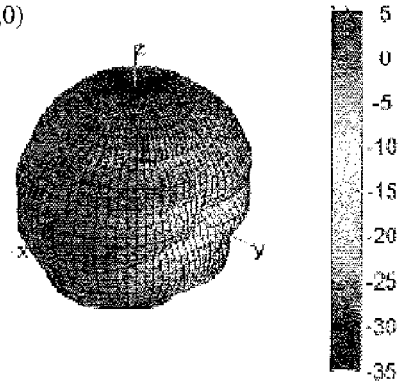
FIG. 8 illustrates radiation patterns of the preferred embodiment operating at 1950 MHz.
Figure 8:
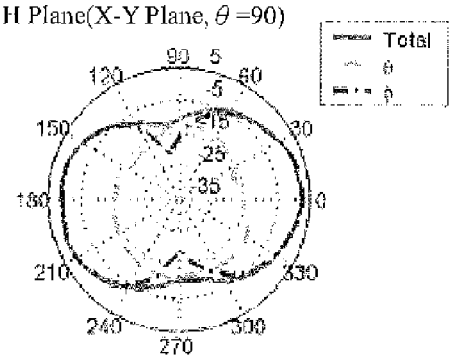
Figure 8:
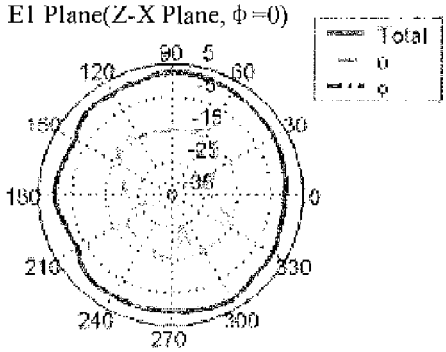
Figure 8:
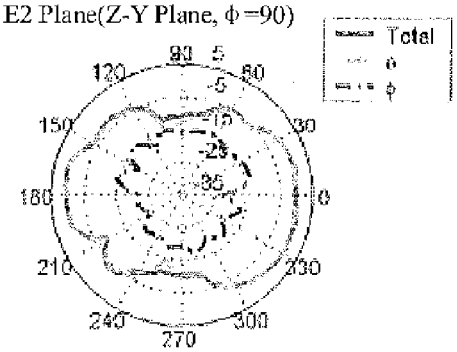

Referring to FIG. 3, which is a voltage standing wave ratio (VSWR) plot of this embodiment, the VSWR values of the multi-band dipole antenna of this embodiment at the first frequency band are smaller than 3:1, and the VSWR values at the second and third frequency bands are smaller than 2:1.

According to Tables 1 and 2 below, the radiation efficiency of the multi-band dipole antenna of this embodiment is greater than 50% at frequencies within the first frequency band, and is greater than 65% at the second and third frequency bands.

TABLE 1

| Frequency Band | Frequency (MHz) | Radiation Efficiency (dB) | Gain (dBi) |
|---|---|---|---|
| GSM850 Tx | 824 | −2.0 | 1.2 |
| | 836.6 | −1.8 | 1.3 |
| | 849 | −1.6 | 1.6 |
| GSM850 Rx | 869 | −1.2 | 1.8 |
| GSM900 Tx | 880 | −1.0 | 2.0 |
| | 894 | −1.1 | 2.1 |
| | 897.4 | −1.2 | 2.1 |
| | 915 | −1.6 | 1.8 |
| GSM900 Rx | 925 | −1.9 | 1.5 |
| | 942.4 | −2.3 | 1.3 |
| | 960 | −2.7 | 1.2 |

TABLE 2

| Frequency Band | Frequency (MHz) | Radiation Efficiency (dB) | Gain (dBi) |
|---|---|---|---|
| DCS 1800 Tx | 1710 | −0.8 | 3.4 |
| | 1747.8 | −0.9 | 3.4 |
| | 1785 | −1.2 | 3.0 |
| DCS 1800 Rx | 1805 | −1.1 | 2.8 |
| PCS 1900 Tx | 1842.8 | −1.1 | 2.8 |
| | 1850 | −1.0 | 2.9 |
| | 1880 | −1.0 | 3.0 |
| | 1910 | −1.0 | 2.8 |
| PCS 1900 Rx | 1920 | −1.2 | 2.9 |
| WCDMA Band I Tx | 1930 | −1.2 | 2.7 |
| | 1950 | −1.2 | 2.9 |
| | 1960 | −1.0 | 2.9 |
| | 1980 | −0.8 | 3.1 |
| | 1990 | −0.7 | 3.3 |
| WCDMA Band I Rx | 2110 | −1.1 | 3.2 |
| | 2140 | −1.3 | 2.9 |
| | 2170 | −1.6 | 2.9 |

FIGS. 4 to 8 illustrate radiation patterns of the multi-band dipole antenna of this embodiment. It is evident that, the radiation patterns of the E1 plane, i.e., Z-X plane, according to this invention have relatively good omni-directionality in the GSM 850, GSM 900, DCS, PCS, and WCDMA Band I frequency bands.

To sum up, the first radiator section 2 cooperates with the first mirroring radiator section 4 to resonate in the first frequency band in a manner as a dipole antenna, the second radiator section 3 cooperates with the second mirroring radiator section 6 to resonate in the second frequency band in a manner similar to a dipole antenna, and the first radiator section 2, the third radiator section 7, and the first mirroring radiator section 4 cooperate to resonate in the third frequency band. Moreover, the multi-band dipole antenna can operate in five frequency bands, i.e., GSM 850, GSM 900, DCS, PCS, and WCDMA Band I for mobile phone communication, and has high omni-directionality, a relatively small size, and a simple structure.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A multi-band dipole antenna comprising:

a substrate;

a first radiator section disposed on said substrate and having a first grounding end and a first conductor arm that extends from said first grounding end in a first direction;

a second radiator section disposed on said substrate, spaced apart from said first radiator section, and having a second grounding end and a second conductor arm that extends from said second grounding end in a second direction;

a first mirroring radiator section symmetrically disposed on said substrate with respect to said first radiator section and spaced apart from said first radiator section, said first radiator section and said first mirroring radiator section having substantially equal lengths, said first mirroring radiator section including a feed-in end that is adjacent to said first grounding end and a first mirroring conductor arm that extends from said feed-in end in a direction opposite to the first direction, said first radiator section cooperating with said first mirroring radiator section to resonate in a first frequency band;

a balun disposed on said substrate and having a main body, a first connecting end electrically connected to said first mirroring conductor arm, and a third grounding end, said first connecting end and said third grounding end being disposed respectively on opposite ends of said main body; and a second mirroring radiator section disposed on said substrate and including a second connecting end that is electrically connected to said main body of said balun, and a second mirroring conductor arm that extends from said second connecting end in a direction opposite to the second direction, said second radiator section cooperating with said second mirroring radiator section to resonate in a second frequency band.

2. The multi-band dipole antenna as claimed in claim 1, further comprising a third radiator section disposed on said substrate and substantially parallel to at least a portion of said first radiator section and at least a portion of said first mirroring radiator section, said first radiator section, said third radiator section, and said first mirroring radiator section cooperating to resonate in a third frequency band.

3. The multi-band dipole antenna as claimed in claim 2, wherein said first conductor arm includes a first radiator portion connected to said first grounding end, a second radiator portion extending at an angle from one end of said first radiator portion opposite to said first grounding end, and a third radiator portion extending from one end of said second radiator portion opposite to said first grounding end and forming a bend with said second radiator portion, said first mirroring conductor arm including a first mirroring radiator portion connected to said feed-in end, a second mirroring radiator portion extending at an angle from one end of said first mirroring radiator portion opposite to said feed-in end, and a third mirroring radiator portion extending from one end of said second mirroring radiator portion opposite to said feed-in end and forming a bend with said second mirroring radiator portion.

4. The multi-band dipole antenna as claimed in claim 3, wherein bandwidth of said first frequency band is dependent upon dimensions of said first radiator section and said first mirroring radiator section, bandwidth of said second frequency band is dependent upon dimensions of said second radiator section and said second mirroring radiator section, and bandwidth of said third frequency band is dependent upon dimensions of said third radiator section and said third mirroring radiator portion.

5. The multi-band dipole antenna as claimed in claim 3, wherein said first radiator portion and said first mirroring radiator portion are disposed on a common line.

6. The multi-band dipole antenna as claimed in claim 5, wherein said third radiator section forms a clearance with each of said first radiator portion and said first mirroring radiator portion, impedance matching and bandwidth of the third frequency band being dependent upon dimensions of said clearance.

7. The multi-band dipole antenna as claimed in claim 1, wherein said second connecting end of said second mirroring radiator section is disposed adjacent to a central part of said main body of said balun.

8. The multi-band dipole antenna as claimed in claim 1, further comprising a coaxial transmission cable disposed on said substrate and having an inner conductor that is electrically connected to said feed-in end and an outer conductor that is electrically connected to each of said first, second and third grounding ends.

9. The multi-band dipole antenna as claimed in claim 1, wherein said substrate is a microwave substrate.

10. The multi-band dipole antenna as claimed in claim 1, wherein said second conductor arm and said second mirroring conductor arm are disposed on a common line.

* * * * *